United States Patent [19]

Tashiro et al.

[11] 4,178,156

[45] Dec. 11, 1979

[54] PROCESS AND APPARATUS FOR THE COLLECTION OF HIGH-RESISTANCE DUST

[75] Inventors: Koji Tashiro, Miki; Yoichi Matsumoto, Takasago, both of Japan

[73] Assignee: Metallgesellschaft AG, Frankfurt am Main, Fed. Rep. of Germany

[21] Appl. No.: 812,430

[22] Filed: Jul. 1, 1977

[30] Foreign Application Priority Data

Jul. 5, 1976 [JP] Japan ..... 51-79079

[51] Int. Cl.[2] ..... B03C 3/08

[52] U.S. Cl. ..... 55/5; 55/10; 55/13; 55/122; 55/133; 55/138; 55/111

[58] Field of Search ..... 55/5, 10, 12, 13, 106, 55/107, 108, 110, 111, 112, 118–120, 122, 128, 133, 134, 138, 151, 152, 157

[56] References Cited

U.S. PATENT DOCUMENTS

| | | | |
|---|---|---|---|
| 1,016,476 | 2/1912 | Cottrell | 55/5 |
| 1,329,825 | 2/1920 | Bradley | 55/5 |
| 1,331,225 | 2/1920 | Wolcott | 55/5 |
| 2,490,979 | 12/1949 | Palmer | 55/110 |
| 2,556,247 | 5/1951 | Hedberg | 55/133 |
| 2,817,412 | 12/1957 | Klemperer | 55/111 |
| 3,957,462 | 5/1976 | Schminke et al. | 55/152 |
| 3,988,127 | 10/1976 | Schumann | 55/13 |
| 3,988,130 | 10/1976 | Ramsey et al. | 55/112 |

*Primary Examiner*—Bernard Nozick
*Attorney, Agent, or Firm*—Karl F. Ross

[57] ABSTRACT

An electrostatic precipitator for the removal of dust from a gas stream entraining same is subdivided into a plurality of flow passages which can be selectively or collectively shut off. When one of these flow passages is closed off, the collecting electrodes can be rapped, after the high voltage has been disconnected, to cause the collecting electrodes to shed their dust. A conductivity-promoting substance in liquid or powder form is then sprayed into the closed-off flow compartment to deposit upon the collecting electrodes thereof and simultaneously the electrodes are energized. Thereafter, the flow of the gas stream entraining the gas through the flow passages is recommenced and electrostatic deposition of dust takes place in the usual manner. The system has been found to be highly effective for the collection of high-resistance dusts and to avoid reverse ionization effects.

9 Claims, 4 Drawing Figures

PROCESS AND APPARATUS FOR THE COLLECTION OF HIGH-RESISTANCE DUST

FIELD OF THE INVENTION

Our present invention relates to a method of and to an apparatus for the removal of high-resistance dusts from a gas stream entraining same. More particularly, the invention deals with improvements in a system for operating an electrostatic precipitator when there is a danger of reverse ionization as is the case when high-resistance dusts are to be collected.

BACKGROUND OF THE INVENTION

An electrostatic precipitator generally comprises a housing having an inlet side and a discharge side and can be used in association with means, e.g. a blower, for inducing a flow of gas through the housing. Within the housing there are provided arrays of collector electrodes in mutually spaced parallel relationship and corona-discharge electrodes. A high-voltage direct-current field is applied between the corona discharge electrodes and the collecting electrodes so that ionization occurs at the discharge electrodes, thereby electrostatically charging the dust particles which are attracted to and collected upon the collecting electrodes.

Such electrostatic precipitators have been found to be highly efficient in the removal of dusts from a gas stream and are effective even for extremely fine dusts and for the handling of large volumes of dust.

However, a problem arises when the dust entrained in the gas stream has a relatively high resistance. In this case, as the dust collects upon the collecting electrode, a reverse-ionization phenomenon is noted and eventually the surface of the collected dust assumes a charge which may be opposite the charge at the surface of the collecting electrode thereby repelling, rather than collecting, additional dust.

As a result, the efficiency of the electrostatic precipitator for collecting high-resistance dust is substantially lowered as reverse ionization takes place or as the tendency toward reverse ionization increases.

It is known to overcome this problem by a chemical-regulating technique which can involve spraying or otherwise dispersing a liquid or solid into the high-resistance dust, the substance having the characteristic of increasing the conductivity of the dust. This conductivity-promoting substance may be a low-resistance material which, in association with the high-resistance dust, reduces the overall resistance of the substances attracted to the collecting electrodes.

When a liquid is used, it may contain sulfur dioxide, ammonia, triethyl amine, etc. The low-resistance dust may be any waste material having a substantially lower resistance than the high-resistance dust to be recovered from the gas stream.

Since the users of an electrostatic precipitator as well as individuals in the neighborhood thereof strongly object to the discharge of such toxic, noxious or polluting chemical liquids from a flue or stack fed from the electrostatic precipitator, it has been impossible to add even traces of such liquids without violating human sensibilities or environmental control laws.

In practice it is found that the addition of low-resistance dusts or powders to the gas stream entering the electrostatic precipitator is also undesirable because it increases the loading of the electrostatic precipitator and frequently appears to the user thereof to be irrational even if the admixed quantity of dust is fully recovered.

OBJECT OF THE INVENTION

It is the principal object of the present invention to provide an improved process for collecting high-resistance dusts which obviates the aforementioned disadvantages.

It is also an object of the invention to provide an improved electrostatic precipitator for the efficient removal of high-resistance dust from a gas stream.

Another object of this invention is to provide, in a method of operating an electrostatic precipitator, an improved technique whereby the efficiency of the electrostatic precipitator can be maintained or sustained even when high-resistance dusts are to be removed from the gas stream.

SUMMARY OF THE INVENTION

The objects and others which will become apparent hereinafter are attained, in accordance with the present invention, in a method of removing a high-resistance dust from a gas stream in an electrostatic precipitator whereby, after the electrostatic precipitator has operated for some time and has a tendency toward reduced efficiency because of the buildup of accumulations of high-resistance dust upon the collecting electrode or electrodes, at least a part of the electrostatic precipitator is closed off and the electrodes of this part are de-energized and the collecting electrode rapped to shed the dust therefrom. Thereafter, a conductivity-promoting substance, in liquid or solid form is dispersed in the aforementioned part of the electrostatic precipitator and the electrodes are simultaneously energized. This attracts the substance to the collecting electrodes and enables, in the next step, the flow of the gas stream to be recommenced and the electrostatic precipitation operation returned to normal.

More particularly, the invention involves the steps, in the operation of an electrostatic precipitator having corona discharge electrodes and collecting electrodes, of closing off at least a part of the dust-collecting section of the electrostatic precipitator, stopping the feed of electricity to both of the electrodes in the closed-off part and thereby enable removal of dust which has previously adhered to the dust-collecting electrode, supplying an electrically conductive substance to the closed-off part between the closures at the ends thereof and simultaneously feeding electricity to both of the electrodes thereof to allow the conductive substance to adhere to the dust-collecting electrode, thereafter blowing the dust-containing gas through the dust-collecting section in the usual manner.

In accordance with the invention, therefore, the process for collecting high-resistance dust from a gas stream entraining same in an electrostatic precipitator having dust-collecting electrodes and discharge electrodes, comprises the steps of interrupting the flow of the gas stream through at least part of the flow cross-section of the electrostatic precipitator and electrically de-energizing the electrodes of this part of the flow cross-section, discharging dust from the dust-collecting electrodes of this part of the flow cross-section, dispersing a conductivity-increasing substance into the aforementioned part of the flow cross-section and simultaneously re-energizing the electrodes of this part, and readmitting the gas stream to the part and effect removal of dust from the readmitted gas stream.

The result is a dust-collecting process which makes it possible to collect high-resistance dust extremely efficiently and reliably without causing secondary pollution.

In its apparatus aspects, the involves partitioning an electrostatic precipitator to subdivide the latter into a plurality of parallel-flow cross-sections each of which is provided with means for hermetically sealing the respective flow cross-section from the remainder of the flow cross sections. Spray means is provided in each of the flow cross sections and is individual thereto so that, upon closing off of the respective flow cross section, the conductivity-promoting substance, i.e. a liquid or solid of the type described previously, can be introduced while the remaining flow cross sections are traversed by the balance of the gas stream to permit continuous solids removal from the gas stream during the efficiency-increasing step which involves depositing the conductivity-promoting substance upon the collecting electrodes of the part of the flow cross section which has been shut off from the gas stream.

Because of the aforementioned steps, even when a fixed layer of the high-resistance dust is formed on the dust-collecting electrodes as a result of the dust collection for a considerable period of time of operation of the electrostatic precipitator, the electric-conductivity promoter substance attached to the dust-collecting electrodes maintains the dust layer electrically conductive and prevents reverse ionization. High-resistance dust can thus be collected with high efficiency.

Because a portion of the flow cross section is hermetically sealed off within the electrostatic precipitator, moreover, the spray of the conductivity-promoting substance therein can be effected, without discharge of the substance into the environment, in a rapid and efficient manner. The conductivity-promoting substance is not dissipated unnecessarily.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
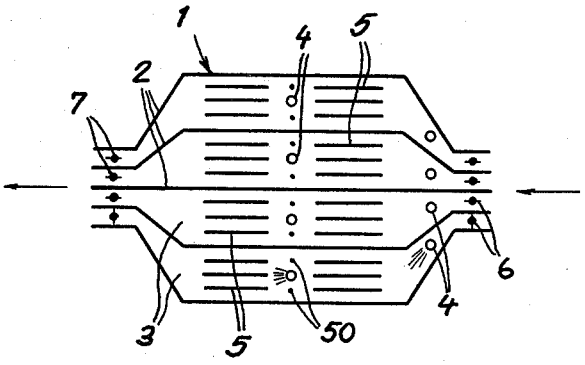
FIG. 1 is a cross-sectional view through an electrostatic precipitator taken in a horizontal plane from above and in diagrammatic form.

In FIG. 1 of the drawing we have shown somewhat diagrammatically an electrostatic precipitator having a casing or housing 1 subdivided internally into several zones or flow cross sections 3 by partition walls 2. The flow compartments extend between an inlet side and an outlet side of the casing, the flow of gas therethrough being represented by the arrows.

Each zone or flow cross section 3 is provided with a least one discharge electrode (see FIG. 3 or FIG. 4 at 50) and a multiplicity of dust-collecting electrodes 5 disposed in mutually spaced parallel relationship.

At the inlet and outlet sides of each flow cross section, moreover, there are provided dampers or butterfly valves 6 and 7 to selectively and individually hermetically seal each of the flow cross sections 3 from the gas stream.

In the region of the aforementioned discharge electrodes, means 4 is provided for spraying a regulating agent, i.e. a conductivity promoter, into respective zone 3. The spray means can be of any type, e.g. orifices in a pipe, designed to effect an efficient dispersal of the powdered low-conductivity substance or sprayable liquid into the flow cross section.

The system illustrated in FIG. 1 operates as follows:

The inlet and outlet flaps 6, 7 of one of the zones 3, e.g. the lower zone in FIG. 1, are closed to intercept the gas stream and to confine hermetically a quantity of the gas therein. The electrodes 50 and 5 in this zones are thereupon de-energized and, using a hammer or rapping device not shown, the dust that has previously attached to the dust-collecting electrodes in this zone is caused to deposit in the dust bin.

The electrically conductive chemical liquid or low-conductivity solid is then sprayed into the zone and simultaneously therewith or after the initial spraying and during dispersal of the conductivity-promoting agent, the electrodes are re-energized to cause the dispersed substance to deposit upon the collecting electrodes. The closed dampers 6 and 7 are then reopened to permit the normal flow of the dust-carrying gas through the previously closed flow cross section and ordinary electrostatic precipitation. The successive flow cross sections 3 may be closed off in similar manner from time to time so that the gas stream traverses the remaining flow cross sections continuously and electrostatic precipitation is not interrupted.

Alternatively, all of the inlet and outlet dampers 6, 7 can be closed simultaneously to carry out the aforementioned procedure in all of the flow cross sections simultaneously.

In accordance with the present invention, therefore, the electrically conductive substance attaches at the collecting electrodes 5 and, even if the high-resistance dust is not completely removed, remains adherent to the dust-collecting electrodes 5 so that reverse ionization is delayed or excluded. The reduction in dust-collecting efficiency because of the tendency toward reverse ionization can thus be lowered.

Figure 2:
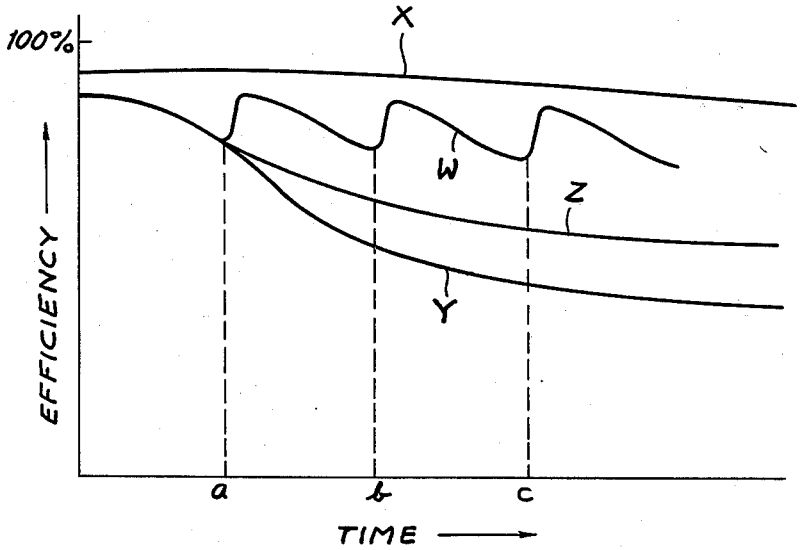
FIG. 2 is a diagram in which efficiency is plotted along the ordinate and time is plotted along the abscissa illustrating an aspect of the invention.

Referring now to FIG. 2, it will be seen that the curve X represents the dust-collecting efficiency for a dust with a resistance below the critical high-resistance values which reduce dust-collecting efficiency by reverse ionization. When, however, a high-resistance dust is processed, the good dust-collecting efficiency can be maintained only for a certain period of time after the onset of precipitator operations, i.e. to the point a which can represent, depending upon the resistance of the dust, the nature of the electrostatic precipitator and other parameters, a period of one month to one year.

The curve Y and the curve Z represent the efficiency drops using dampers and without dampers, but without the intermittent blocking of flow cross sections and the charging of the closed-off section with the conductivity-promoting substance. The latter is introduced at times a, b and c and at each of these times results in an increase in the dust-collecting efficiency. Naturally the average efficiency with the system of the present invention as represented by the curve W is substantially higher than that obtained without the steps of the present invention and only slightly below the efficiency X for a low-resistivity dust. Since the conductivity-promoting agent is practically 100% recovered by attachment to the collecting electrodes, there is no danger of environmental pollution or distress.

Figure 3:
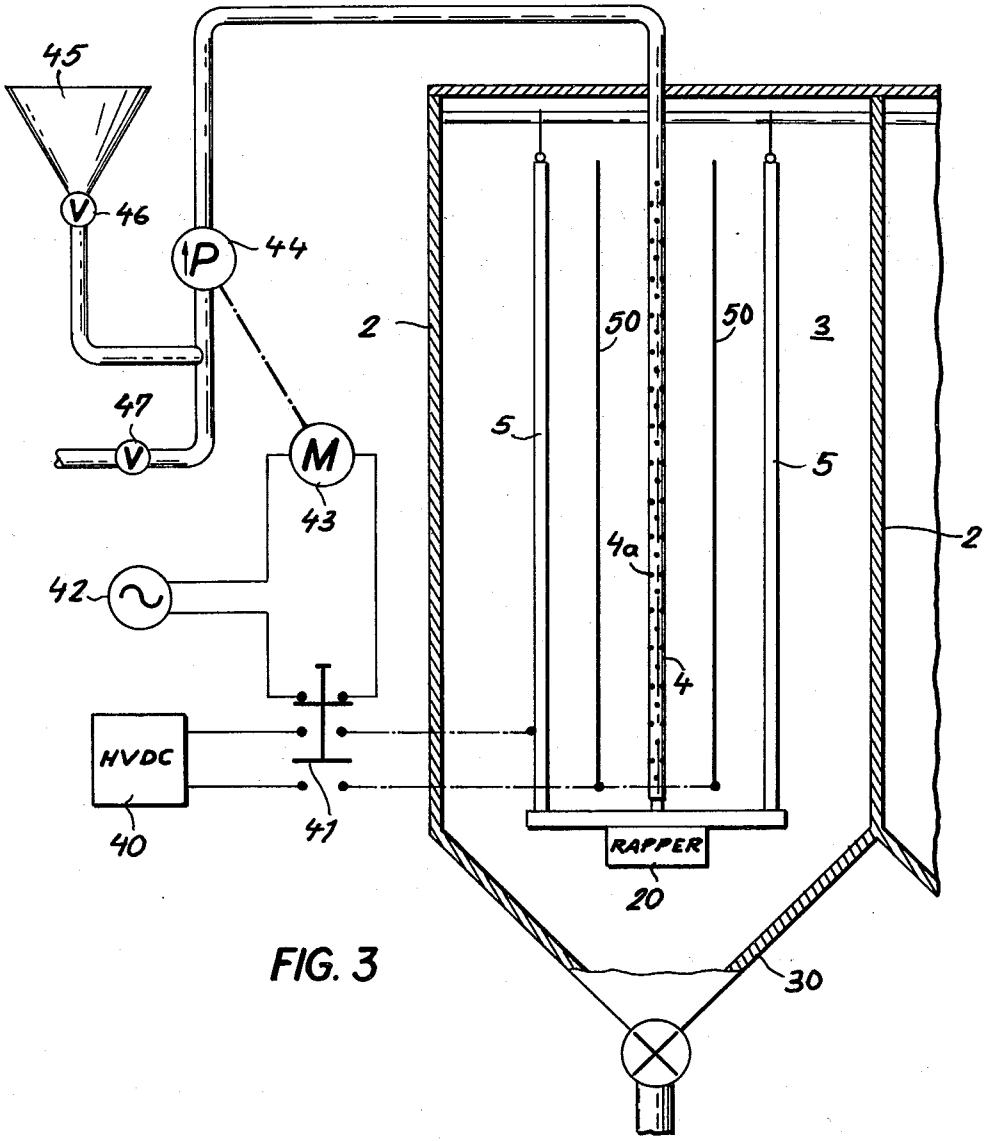
FIG. 3 is a vertical section through a flow compartment of an electrostatic precipitator according to the invention.

In FIG. 3, we have shown in cross section a portion of the flow compartment 3 which is closed off during the spraying of the conductivity-promoting substance into this flow cross section. In this embodiment, each corona discharge electrode 50 is formed as a wire. The spray pipe 4 has orifices 4a from which the substance is discharged. The substance can be fed to the pipe 4 by a pump 44 driven by a motor 43 and supplied with the pneumatically carried powder material from a hopper 45 via a valve 46 or with the liquid through a valve 47.

The motor 43 is energized by a switch 41 when the latter cuts off the high-voltage direct-current source which is otherwise connected across the electrodes 50, 5. The source has been indicated at 40 in FIG. 3.

The dust bin 30 of this flow cross section is also hermetically sealed and the rapper 20 can be connected to the bottom end of the collector electrodes 5 which are otherwise suspended from a support at the top of the precipitator.

Figure 4:
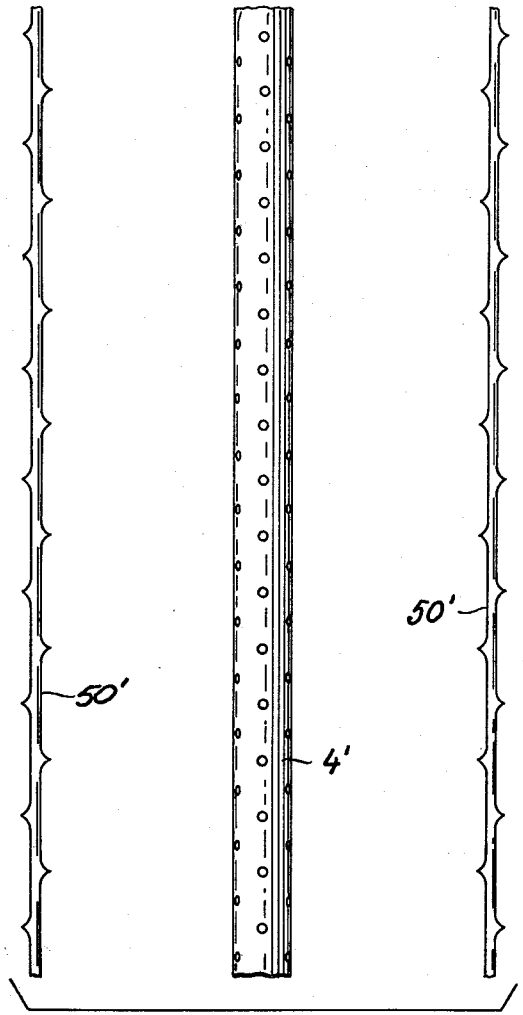
FIG. 4 is an elevational view illustrating another arrangement of the corona discharge electrodes which may be used in the electrostatic precipitator of FIG. 3.

FIG. 4 shows an embodiment of the invention in which a separate spray pipe 4' is provided in coplanar relationship with the corona discharge electrodes 50' which can be of conventional design.

We claim:

1. A process for collecting high-resistance dust from a gas stream entraining same in an electrostatic precipitator having dust-collecting electrodes and discharge electrodes, said process comprising the steps of:

(a) interrupting the flow of said gas stream through a part of the flow cross section of said electrostatic precipitator by closing off said part of said flow cross section between opposite ends thereof;

(b) electrically de-energizing the electrodes selectively of said part of the flow cross section of said electrostatic precipitator;

(c) discharging dust from the dust-collecting electrodes of said part of said electrostatic precipitator selectively by rapping the dust-collecting electrodes of said part while they are de-energized;

(d) spraying a conductivity-increasing substance into said part of said flow cross section between the closed-off ends thereof while the electrodes of said part are denergized;

(e) re-energizing the electrodes of said part of said electrostatic precipitator, thereby attracting said conductivity-increasing substance at least in part to said dust-collecting electrodes of the closed-off part whereby said substance adheres to said dust-collecting electrodes in said part of said electrostatic precipitator; and (f) readmitting said stream of gas to said part of said electrostatic precipitator to effect removal of dust from the readmitted gas stream, the removal of dust from the gas stream continuing in the balance of the flow cross section during steps (a) to (e).

2. The process defined in claim 1, further comprising the step of repeating the sequence of interruption of the flow of said gas stream through readmission of the gas of said stream in successive flow cross sections of said electrostatic precipitator while permitting the continuous flow of gas through other flow cross sections thereof.

3. The process defined in claim 1 wherein said electrodes of said part of said electrostatic precipitator are re-energized simultaneously with the dispersal of said conductivity-increasing substance into said part of said flow cross section.

4. The process defined in claim 3 wherein said conductivity-increasing substance is a liquid and is sprayed into said part of said flow cross section.

5. The process defined in claim 3 wherein said conductivity-increasing substance is a powder dispersed into said part of said flow cross section.

6. A method of operating an electrostatic precipitator having dust-collecting electrodes and discharge electrodes, said electrostatic precipitator being subdivided into a plurality of parallel flow cross sections, said process comprising the steps of:

(a) interrupting the flow of a gas stream through one of said flow cross sections selectively by closing off said one of said flow cross sections at opposite ends thereof;

(b) electrically de-energizing the electrodes of said one of said flow cross sections upon the closing off thereof;

(c) discharging dust from the dust-collecting electrodes of said one of said flow cross sections selectively upon the closing off thereof by rapping the dust-collecting electrodes of said one of said flow cross sections;

(d) spraying a conductivity-increasing substance into said one of said flow cross sections between the closed-off end thereof and simultaneously re-energizing the electrodes of said one of said flow cross sections whereby said substance adheres at least to said dust-collecting electrodes of said one of said flow cross sections; and (e) readmitting said stream to said one of said flow cross sections to effect removal of dust from the readmitted gas stream, the removal of dust from the gas stream continuing in the balance of the flow cross section during steps (a) to (d).

7. The method defined in claim 6 wherein, after the readmission of said gas stream to said one of said flow cross sections, the flow of said gas stream through another of said flow cross sections is interrupted and the sequence of said steps is repeated for said other of said flow cross sections.

8. In an electrostatic precipitator having a housing, dust-collecting electrodes, and discharge electrodes, the improvement which comprises:

means partitioning the interior of said electrostatic precipitator into a plurality of parallel flow cross sections each having an inlet and an outlet side;

respective dampers at each of said inlet and outlet sides for selectively and individually hermetically sealing the respective flow cross section from a stream of gas traversing said electrostatic precipitator, each ofsaid flow cross sections having at least one dust-collecting electrode and at least one discharge electrode;

means for selectively electrically energizing and de-energizing the electrodes of each of said flow cross sections whereby the electrodes of a closed-off flow cross section can be de-energized and re-energized apart from the electrodes of the remaining flow cross sections;

means for rapping the dust-collecting electrodes of each of said flow cross sections selectively as each is sealed off from others and the respective electrodes are de-energized; and means between the respective dampers for spraying into each of said flow cross sections a conductivity-promoting substance while the respective flow cross section is hermetically sealed between the respective dampers.

9. The improvement defined in claim 8 wherein the last-mentioned means is provided in the region of the respective discharge electrode.

* * * * *